US006010019A

United States Patent [19]

Johnston

[11] Patent Number: 6,010,019

[45] Date of Patent: Jan. 4, 2000

[54] DUAL BEAM HEADER CONNECTOR PLATE

[75] Inventor: Roger L. Johnston, Muskego, Wis.

[73] Assignee: J & R Engineering Company, Inc., Mukwonago, Wis.

[21] Appl. No.: 08/896,707

[22] Filed: Jul. 18, 1997

[51] Int. Cl.[7] ..... B66C 5/00

[52] U.S. Cl. ..... 212/324; 104/126; 212/253

[58] Field of Search ..... 384/209, 213, 384/498; 104/126; 212/312, 314, 324, 325, 226, 225, 227, 228, 253

[56] References Cited

U.S. PATENT DOCUMENTS

| | | | |
|---|---|---|---|
| 903,806 | 11/1908 | Andresen | 212/325 |
| 4,381,839 | 5/1983 | Engler et al. | 212/314 |

FOREIGN PATENT DOCUMENTS

| | | | |
|---|---|---|---|
| 591392 | 2/1978 | U.S.S.R. | 212/324 |
| 2177374 | 1/1987 | United Kingdom | 212/253 |

*Primary Examiner*—Thomas J. Brahan
*Attorney, Agent, or Firm*—Nilles & Nilles, S.C.

[57] ABSTRACT

A gantry lift includes one or more pairs of vertically extendible lift columns and one or more horizontal lift beams supported across the upper ends of the lift columns. The lift beams are supported on header plates that permit slight pivoting or rocking motion between the lift beams and the lift columns. This helps counteract potentially destructive twisting or other forces that can result as the gantry operates and slight misalignments unavoidably occur. A half bearing between the header plate and the upper end of the lift column supports the weight of the lift beam and load and provides the desired pivoting action. The header plate and half bearing are secured to the top of the lift column by means of a full bearing positioned within the half bearing and secured to the lift column by a bolt or other fastener. Both the half bearing and the full bearing pivot around a common center. This method of securing the header plate permits the header plate to pivot freely over a desired range while resisting separating movement of the header plate relative to the lift column.

20 Claims, 4 Drawing Sheets

DUAL BEAM HEADER CONNECTOR PLATE

BACKGROUND OF THE INVENTION

This invention relates generally to gantry lifts and, more particularly, to header connector plates in such gantry lifts.

Hydraulic gantry lifts are well-known lift devices that are well-suited for certain types of specialized lifts. Known gantry lifts, such as those shown, for example, in U.S. Pat. No. 5,360,123 issued Nov. 1, 1994 to Johnston and commonly owned by the assignee hereof, include a pair of spaced, mobile base units or lift housings, each having an upwardly extendable column. Each column includes a plurality of telescoping sections and a hydraulic cylinder within the sections that operates to raise and lower the column. A horizontal lift beam typically extends across the upper ends of the columns, and the load to be lifted is suspended from the beam. By raising and lowering the columns, the load can be lifted for transport or lowered for disengagement from the beam.

Typically, each of the base units is self-propelled for horizontal movement. After the load is raised, the base units can be actuated to transport the raised load horizontally over the ground, floor or other underlying surface. In the usual arrangement, a track including a pair of spaced, horizontal "I" beams is provided along the path over which the load is to be moved. Each base unit sits on and moves along the beams. By coordinating the extension of the columns and the movement of the base units along the track, the load can be lifted, transported horizontally and then lowered at a new location.

As the load is lifted and transported, it is difficult to maintain precise alignment among the various lift housings, lift columns and lift beam. Slight misalignments can occur if one of the lift columns extends slightly more or less than the other or if one of the lift housings moves slightly ahead of or behind the other along the track. Because of the often considerable length of the lift boom and the resulting lever arm, slight misalignments can nevertheless translate into tremendous torques when multiplied over the length of the lift boom.

To accommodate such unavoidable misalignments and to avoid the potentially destructive forces they can induce, it is common to couple the lift boom to the top of each column through a header plate that permits and accommodates slight movement between the lift boom and lift columns. Typically, the header plate is coupled to the top of the lift column through a structure, such as a half bearing, that permits limited pivoting movement of the header plate relative to the lift column. Half bearings are particularly well suited for this purpose in that they can provide the desired pivoting action while maintaining a low device height or profile. The half bearing, and the header plate that it supports, permit the lift beam to pivot slightly in both the longitudinal and transverse directions relative to the lift column as the gantry lifts and transports the load. This maintains the overall structural integrity of the system while avoiding the development of potentially destructive forces as slight misalignments unavoidably occur.

By nature of their design, half bearings are capable of withstanding large loads in one direction only. When used between the header plate and the top of a lift column, a half bearing has the capacity to bear the weight of the lifted load, but is unable, by itself, to resist forces tending to lift the header plate away from the top of the lift column. Accordingly, the header plate and the half bearing are typically secured to the top of the lift column by means of a bolt passing through the header plate and half bearing. To permit limited pivoting movement of the half bearing, a spacer arrangement is used that provides clearance between the bolt head and a radial or central portion of the half bearing. Although the resulting gap between the underside of the bolt head and the radial part of the half bearing allows the half bearing to pivot, the gap also permits some upward vertical movement of the header plate relative to the top of the lifting column and limits the structural strength of the gantry if a strong separating force is somehow developed.

SUMMARY OF THE INVENTION

The invention provides a header plate assembly for supporting a lift beam at the upper end of a lift column in a gantry. The header plate assembly includes a full bearing, a half bearing positioned around the full bearing, a header plate positioned over the full bearing and coupled to the half bearing, and a fastener extending through the half bearing and the full bearing operable to couple the header plate assembly to the lift column.

The invention also provides a vertical lift column for supporting and raising a horizontal lift beam in a gantry. The vertical lift column includes a column section having an upper end. The vertical lift column further includes a half bearing assembly having a half bearing outer race received in the upper end of the column section and an inner half bearing engaging the half bearing outer race for pivoting movement relative to the half bearing outer bearing race around a center of rotation. The vertical lift column further includes a header plate having a central portion coupled to the inner half bearing for movement with the inner half bearing, a full bearing assembly having a full bearing outer race coupled to the central portion of the header plate and an inner full bearing engaging the full bearing outer race for pivoting movement relative to the full bearing outer race substantially around the center of rotation. A fastener couples the inner full bearing to the upper end of the column section to prevent vertical movement of the inner full bearing relative to the upper end of the column section so that engagement of the inner half bearing with the half bearing outer race withstands compressive forces applied between the header plate and the lift column and engagement of the inner full bearing with the full bearing inner race withstands separating forces applied between the header plate and the lift column while the header plate remains pivotable around the center of rotation.

The invention also provides a header plate assembly for supporting a lift beam at the upper end of a lift column in a gantry. The header plate assembly comprises a support plate, mountable at the upper end of the lift gantry, having a central recess. A half bearing race is received in the central recess, and a header plate having a support collar projecting from one side thereof is provided. The support collar has an open interior. A half bearing is disposed around the support collar and engages the half bearing race so that the header plate is supported above the support plate by the half bearing and by the half bearing race for pivoting movement relative to the support plate. A full bearing race is received in the open interior of the support collar, and a full bearing is received in the full bearing race and secured to the support plate so as to restrain the full bearing race and the header plate coupled thereto against vertical separating movement relative to the support plate.

It is an object of the invention to provide a new and improved gantry lift.

It is a further object of the invention to provide a new and improved gantry lift that accommodates slight misalignments during gantry operation without compromising the structural integrity of the gantry.

It is also an object of the invention to provide a header plate assembly for a gantry lift that permits limited pivoting movement of a horizontal lift beam relative to a vertical lift column and is capable of withstanding separating forces between the lift beam and the lift column.

It is a further object of the invention to provide a header plate assembly that maintains a low profile between the header plate and the top of the lift column.

It is a further object of the invention to provide a method of fastening a half bearing to a supporting structure so that the half bearing is permitted to pivot over a range but is substantially fully restrained from separating movement relative to the supporting structure.

It is a further object of the invention to provide a method of coupling a lift beam to the upper end of a lift column of a lift gantry that is secure and reliable in operation and economical in manufacture and that reduces the potentially damaging effects of slight misalignments that occur as the lift gantry is operated.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DESCRIPTION OF THE PREFERRED EMBODIMENT

Figure 2:
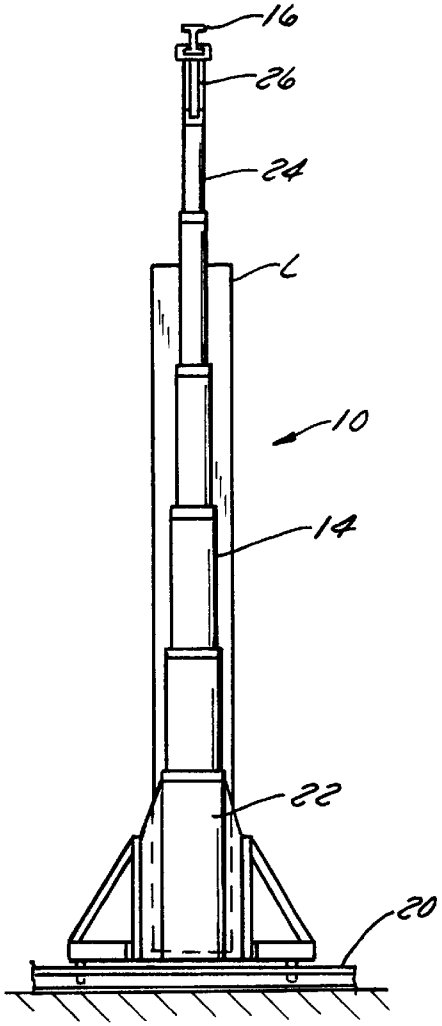
FIG. 2 is a side elevation view of the gantry lift shown in FIG. 1.
Figure 1:
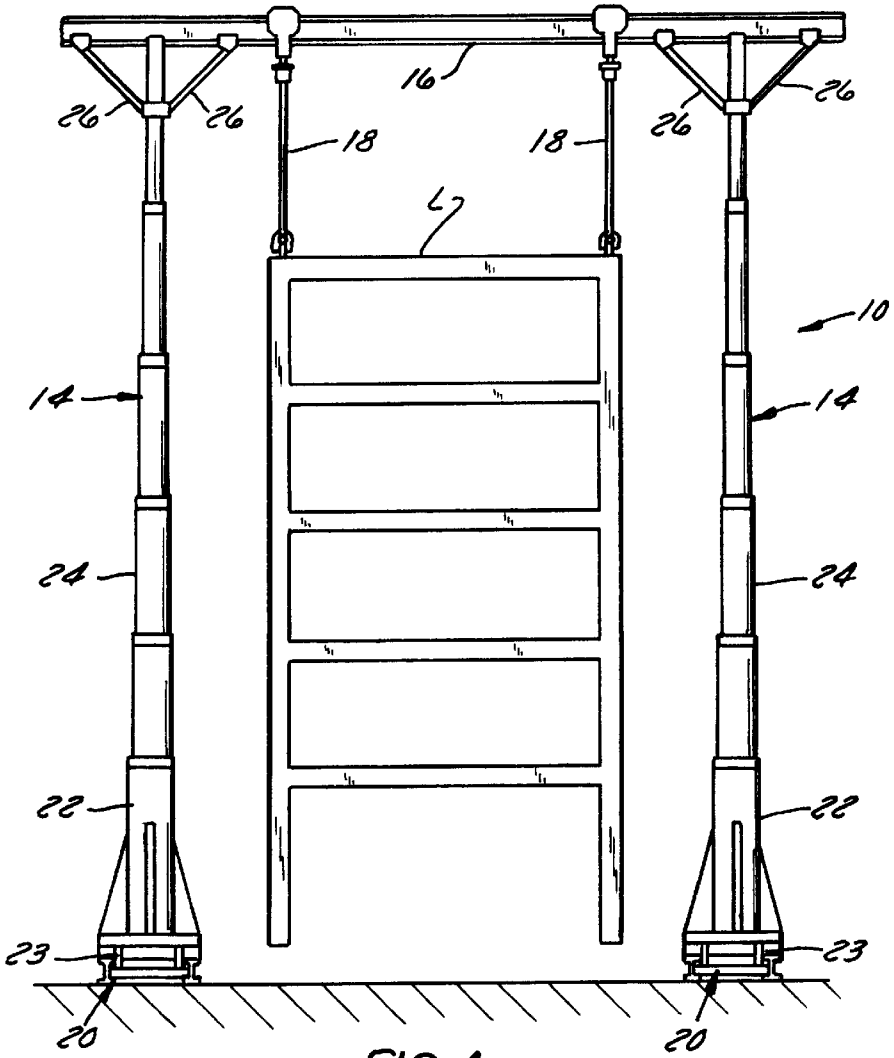
FIG. 1 is a front elevation view of a gantry lift equipped with beam header connector plates constructed in accordance with various aspects of the invention.

Referring to the drawings, and in particular to FIGS. 1 and 2, a hydraulic lift gantry 10 is illustrated. As shown, the lift gantry 10 includes two vertically extendible lifting legs 12, 14 that support a substantially horizontal lifting beam 16 across their upper ends. A load L is suspended from the lifting beam 16 by means of various known rigging devices 18, such as chains, cables, etc. The load L can be raised and lowered by extending and retracting the lifting legs 12, 14.

In addition to raising and lowering the load L, the lift gantry 10 also functions to transport the load L substantially horizontally over the ground. To this end, the lifting legs 12, 14 rest on, and are movable along, a pair of spaced tracks 20.

Each of the lifting legs 12, 14 includes a mobile base 22 that is supported by one of the tracks 20 and that is powered for self-propelled movement along the track 20. Typically, a plurality of wheels 23 (FIGS. 3, 4) on the underside of the base 22 rest on the track 20, and an electric or hydraulic motor within the base 22 is coupled to the wheels to propel the base 22 in either direction along the track 20.

Each of the lifting legs 12, 14 also includes an upwardly extending, telescoping lift column 24 that can be raised or lowered by means of a hydraulic cylinder contained within the column 24. Structure for operating the hydraulic cylinder is also contained within each mobile base 22.

The lifting beam 16 preferably comprises an elongate, rigid "I" beam formed of steel or other such strong, durable material. The lifting beam 16 is supported across the tops of the lift columns 24 and is oriented substantially at right angles to the lift columns 24. In the illustrated embodiment, the ends of the lift beam 16 project outwardly beyond the lift columns 24, and a pair of diagonally extending stabilizer bars 26 reinforce and stabilize the lift beam 16 relative to the adjacent lift column 24. The stabilizer bars 26 are preferably of the type shown and described in the inventor's U.S. Pat. No. 5,360,123 entitled, "Gantry Stabilizer" and issued Nov. 1, 1994, the specification of which is incorporated by reference herein.

It will be appreciated that as the mobile bases 22 move along the tracks 20, and as the lift columns 24 extend and retract vertically, it is difficult if not impossible to maintain a precise right angle or perpendicular alignment of the lift beam 16 relative to the lift columns 24. Inevitably, one of the bases 22 will travel slightly faster than the other, and inevitably, one of the lift columns 24 will extend or retract slightly faster than the other. In either case, the effect will be to disturb the precise perpendicular alignment of the lift beam 16 relative to the lift columns 24. Given the length of the lift beam 16, such misalignments, even if small, can be magnified greatly when multiplied by the length of the lift beam 16. If the lift beam 16 were to be welded or otherwise rigidly affixed to the upper ends of the lift columns 24, even small, unavoidable misalignments could still result in tremendous torques and potentially destructive shearing forces when magnified by the length and rigidity of the lift beam 16. For this reason, it is preferable to avoid a rigid connection between the lift beam 16 and the ends of the lift columns 24 and instead to provide for limited relative movement between the lift beam 16 and the upper ends of the lift columns 24. As disclosed in the aforementioned U.S. Pat. No. 5,360,123, limited relative movement between the lift beam 16 and the lift columns 24 is provided by means of a header plate assembly that is mounted to the upper end of the lift column 24 and that supports the lift beam 16. In the illustrated embodiment, such a header plate assembly 28 is best seen in FIGS. 3–7.

Figure 3:
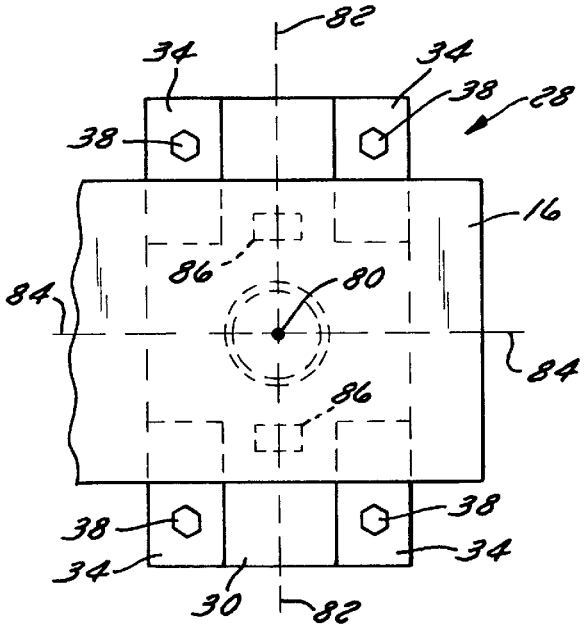
FIG. 3 is a top plan view of a beam resting on a beam header connector plate constructed in accordance with various aspects of the invention.
Figure 4:
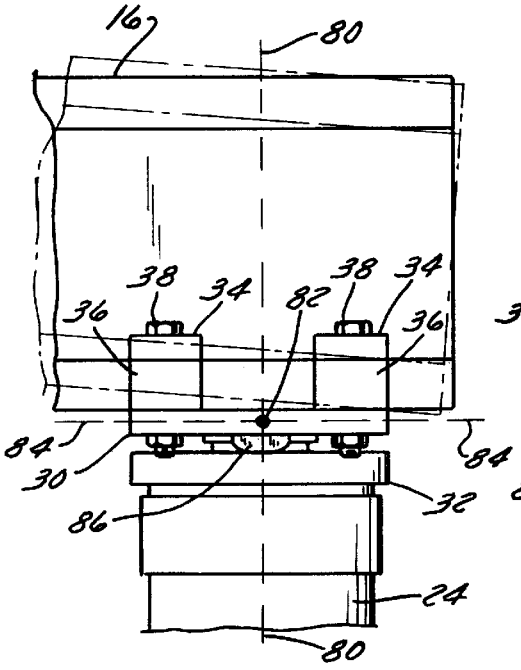
FIG. 4 is a front elevation view of a beam resting on a beam header connector plate constructed in accordance with various aspects of the invention.
Figure 5:
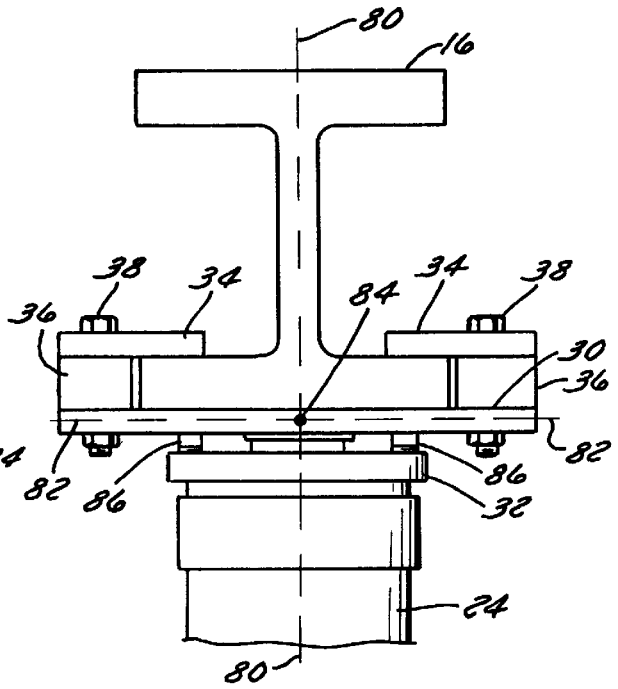
FIG. 5 is a side elevation view of a beam resting on a beam header connector plate constructed in accordance with various aspects of the invention.

Referring to FIG. 3–5, the header plate assembly 28 embodying various features of the invention includes a substantially rectangular header plate 30 positioned above and supported by a square or rectangular support plate 32 affixed to the upper end of the lift column 24. The lift beam 16 extends over and across the header plate 30 and is locked to the header plate 30 by means of four dogs 34 that are located at the corners of the header plate 30 and that overlap the bottom flange of the lift beam 16. Four spacers 36 that are substantially the same thickness as the thickness of the bottom flange support the dogs 34 above the header plate 30, and four nuts and bolts 38 extending through the dogs and spacers can be tightened to clamp the lift beam 16 to the header plate 30.

The support plate 32 preferably comprises a square or rectangular rigid steel plate that conforms generally to the cross-sectional shape of the upper end of the lift column 24. The support plate is welded, bolted or otherwise firmly attached to the upper end of the lift column 24.

Figure 7:
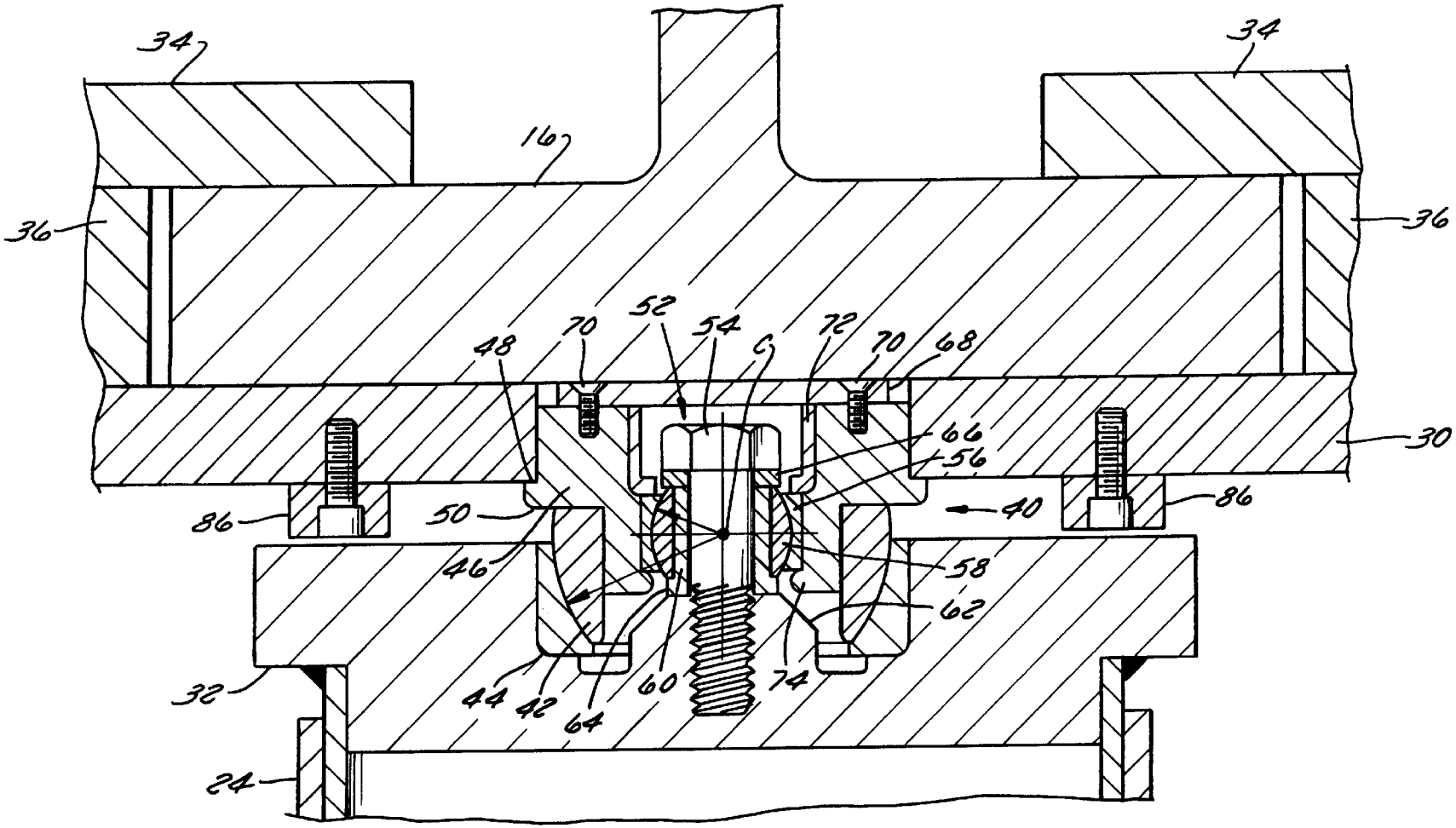
FIG. 7 is a side elevation view of the full bearing assembly.

To provide for limited relative movement between the lift beam 16 and the lift column 24, the header plate 30 is supported for limited pivoting or rocking movement relative to the support plate 32. Such limited pivoting movement is provided by means of a half bearing assembly 40 (FIG. 7) located between the header plate 30 and the support plate 32. Referring further to FIG. 7, the half bearing assembly 40 is substantially centrally aligned with the center of the lift column 24 and includes a half bearing 42 and a half bearing race 44. The half bearing race 44 is received in a recess formed in the upper surface of the support plate 32. The half bearing 42 is mounted on the exterior of a support collar 46 that depends downwardly from the underside of the header plate 30. The interior of the support collar 46 is hollow as shown for reasons that will be explained below.

As illustrated, the support collar 46 is substantially cylindrical in form and is received in a circular aperture formed in the center of the header plate 30. A first step 48 formed in the exterior of the support collar 46 adjacent its upper end forms an annular ledge that limits inward movement of the support collar 46 relative to the header plate 30. A second step 50, formed in the exterior of the support collar 46 below the first step 48, forms another annular ledge that engages the upper end of the half bearing 42 and limits downward movement of the support collar 46 and the header plate 30 relative to the half bearing 42. It will be appreciated that the weight of the header plate 30, the lift beam 16 and the load L suspended by the lift beam 16 is supported by the half bearing 42 resting in the half bearing race 44. It will be appreciated further that the half bearing 42 and the half bearing race 44 permit the header plate 30 and the lift beam 16 supported thereon to pivot or rock over a limited range relative to the support plate 32 and the top of the lift column 24. It will also be appreciated that such pivoting action can be in any direction unless limited by external means.

Ordinarily, the weight of the header plate 30, the lift beam 16 and the load L keeps the half bearing 42 firmly engaged with the half bearing race 44. The half bearing 42 and half bearing race 44 are well-suited to supporting such weights. However, the half bearing 42 and half bearing race are not able, by themselves, to resist separating movement of the header plate 30 relative to the support plate 32. Other means must be provided for keeping the header plate 30 from lifting away from the support plate 32.

In prior header plate arrangements, such as that shown in the aforementioned U.S. Pat. No. 5,360,123, the header plate was secured to the support plate by means of a bolt that passed through the support collar and engaged the support plate. The head of the bolt prevented complete separation of the header plate from the support plate. However, in order to permit the header plate to pivot or rock relative to the support plate, it was necessary to provide a gap or vertical clearance between the underside of the bolt head and the support collar. Although effective in preventing complete separation of the header plate from the support plate, this gap or clearance nevertheless enabled the header plate to move or separate slightly from the support plate by the distance of the gap. Such separation can weaken the overall structure and is undesirable if separating forces from time to time are developed as the lift gantry operates.

In accordance with one aspect of the invention, means are provided for securing the header plate 30 to the support plate 32 without permitting relative vertical motion therebetween and without restricting the ability of the header plate 30 to pivot relative to the support plate 32. To this end, the header plate 30 is secured to the support plate by means of a full bearing assembly 52 positioned within the support collar 46 and secured to the support plate 32 by means of a bolt 54.

As illustrated in FIG. 7, the full bearing assembly 52 includes a full bearing race 56 carried by, and movable with the support collar 46, and a full bearing 58 affixed to the support plate 32 by means of the bolt 54. Preferably, the full bearing 58 encircles an inner bushing 60 that rests on an upwardly extending post or boss 62 formed at the center of the recess in the upper surface of the support plate 32. The bolt 54 threads into the boss 62 and clamps the bushing 60 tightly against the boss 62. The full bearing 58 is captured between an outwardly extending annular flange 64 at the base of the bushing 60 and a washer 66 positioned between the underside of the bolt head 54 and the top of the bushing 60. When so mounted, the full bearing 58 is fixed relative to the support plate 32 and can move neither up nor down relative to the support plate 32.

When the full bearing 58 is received in the full bearing race 56, the full bearing race 56 is free to rotate and pivot relative to the full bearing 58 but is unable to be separated vertically from the full bearing 58. The full bearing race 56 is locked against vertical movement relative to the support collar 46 and the header plate 30 by means of a locking cap 68 that is secured to the top of the support collar 46 by means of a plurality of screws 70 and that includes a downwardly extending central portion 72 that bears against the top of the full bearing race 56. This traps the full bearing 56 between the underside of the central portion 72 and an inwardly extending annular ledge 74 formed at the base of the support collar 46, thereby preventing relative vertical movement between the full bearing race 56 and the header plate 30. Because the full bearing 58 is not vertically movable relative to the support plate 32, and because the full bearing race 56 is not vertically movable relative to the full bearing 58, the support collar 46 and the header plate 30, the full bearing assembly 40 effectively secures the header plate 30 to the support plate 32 so as to resist vertically separating movement while permitting limited pivoting movement between the two.

As further illustrated in FIG. 7, the full bearing 58 and the half bearing 42 are both positioned around a common center C. This enables the header plate 30 to pivot relative to the support plate without causing binding in either the full bearing assembly 52 or the half bearing assembly 40.

It will be appreciated that the half bearing and full bearing arrangement shown and described herein permits movement of the header plate 30 in all directions relative to the support plate 32. However, depending upon the configuration of the gantry used for any particular lift, it is sometimes desirable to limit the direction and amount of permissible movement between the header plate 30 and support plate 32. For example, when only two bases 22 are used and a single lift beam 16 supports the load L (i.e., a "two point" lift), it is desirable to permit rocking movement of the beam in only two of the three possible axes of rotation. In particular, to allow for the possibility that one base might travel horizontally faster than the other, rocking or twisting movement of the beam around the vertical axis 80 (FIGS.3–5) extending through each lifting leg 24 is desirable. Similarly, to allow for the possibility that one lifting leg 24 will extend or retract faster than the other, rocking or twisting movement around the horizontal axis 82 extending parallel to the direction of gantry horizontal movement is desirable. However, with such a two point lift, there is no need to permit rocking movement of the beam 16 around the horizontal axis 84 extending parallel to the length of the beam 16. Accordingly, the header plate assembly 28 preferably includes means for restricting such pivoting movement in selected directions. In the illustrated embodiment, this is achieved through the use of rockers 86 bolted or otherwise removably secured to the underside of the header plate 30 between the header plate 30 and the support plate 32.

As best seen in FIGS. 3–5, rocking movement of the beam 16 around the axis 84 extending the length of the beam is substantially prevented by means of two rockers 86 spaced on opposite sides of the axis 84. As best seen in FIG. 4, the rockers 86 contact the upper surface of the support plate 32 to substantially prevent rocking movement of the header plate 32 around the axis 84. The underside of each rocker 86 is preferably curved as shown to permit rocking movement of the header plate 30 around the other horizontal axis 82. Similarly, the rockers 86 are slidable along the upper surface of the support plate 32 to permit twisting movement of the header plate 30 around the vertical axis 80. It will be appreciated that by removing the rockers 86, movement around all three axes 80, 82 and 84 is permitted. It will also be appreciated that by locating the same or additional rockers 86 on opposite sides of the other horizontal axis 82, rocking movement around this axis 82 can be substantially prevented as well.

Figure 6:
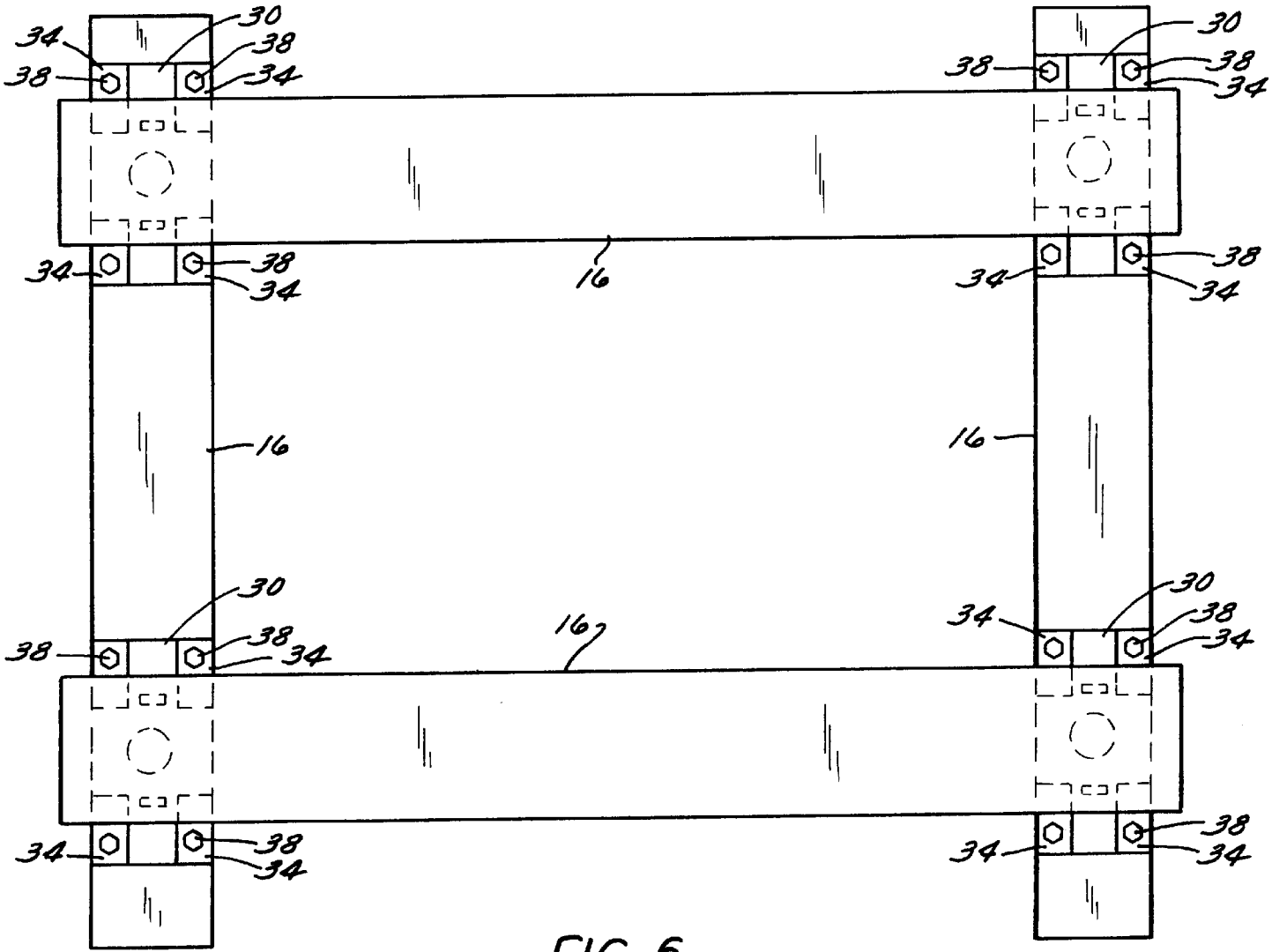
FIG. 6 is a top plan view of a lift gantry incorporating four lifting legs, each equipped with a beam header connector plate constructed in accordance with various aspects of the invention.

When four separate bases 22 supporting four lift beams 16 are used to form a lift gantry as in FIG. 6 (i.e., a "four point" lift), it is desirable that each header plate 30 be permitted to rock or twist around each of the available axes 80, 82 and 84. Accordingly, when a four point lift is intended. the rockers 86 are preferably removed from the underside of each header plate 30 to permit such complete freedom of movement.

It will be appreciated that, although a particular embodiment of the invention has been shown and described, such embodiment is meant to be illustrative rather than limiting. In particular, it will be appreciated that, in any particular system or device, the relative dimensions and thicknesses of the various plates, bearings, fasteners etc. will be dictated by the particular requirements of the use contemplated. In general, the components will be selected so as to assure adequate strength, durability, longevity etc., for the intended use. Accordingly, the various relative dimensions, materials, configurations etc., shown and described herein are not critical to the invention in its broader aspects and, in any particular application, will be selected in accordance with sound engineering practices.

While a particular embodiment of the invention has been shown and described, it will be obvious to those skilled in the art that changes and modifications can be made without departing from the invention in its broader aspects, and, therefore, the aim in the appended claims is to cover all such changes and modifications as fall within the true spirit and scope of the invention.

I claim:

1. A header plate assembly for supporting a lift beam at the upper end of a lift column in a gantry, comprising:

a full bearing:

a half bearing positioned around the full bearing and spaced therefrom;

a header plate positioned over the full bearing and coupled to the half bearing; and, a fastener extending through the half bearing and the full bearing and operable to couple the header plate to the lift column.

2. A header plate assembly as defined in claim 1 wherein the full bearing and the half bearing are positioned around a common center.

3. A header plate assembly as defined in claim 1 further comprising a full bearing race engaging the full bearing and coupled to the half bearing, the full bearing race thereby being operable to resist vertical separating movement between the full bearing and the half bearing.

4. A header plate assembly as defined in claim 3 wherein the fastener fastens the full bearing so as to prevent vertical separating movement of the full bearing relative to the lift column.

5. A header plate assembly as defined in claim 4 wherein the header plate assembly further includes a support plate engageable with the upper end of the lift column.

6. A header plate assembly as defined in claim 5 wherein the support plate is positioned between the header plate and the upper end of the lift column.

7. A header plate assembly as defined in claim 6 wherein the header plate assembly further includes a half bearing race engaging the half bearing.

8. A header plate assembly as defined in claim 7 wherein the half bearing race is supported by the support plate.

9. A header plate assembly as defined in claim 8 wherein the fastener engages the support plate.

10. A header plate assembly as defined in claim 9 further including a rocker between the header plate and the support plate for limiting pivoting movement of the header plate in selected directions relative to the support plate.

11. A vertical lift column for supporting and raising a horizontal lift beam in a gantry, comprising:

a column section having an upper end;

a half bearing assembly having a half bearing outer race coupled to the upper end of the column section and an inner half bearing engaging the half bearing outer race for pivoting movement relative to the half bearing outer bearing race around a center of rotation;

a header plate coupled to the inner half bearing for movement with the inner half bearing;

a full bearing assembly having a full bearing outer race coupled to the central portion of the header plate and an inner full bearing engaging the full bearing outer race for pivoting movement relative to the full bearing outer race substantially around the center of rotation; and a fastener coupling the inner full bearing to the upper end of the column section to prevent vertical movement of the inner full bearing relative to the upper end of the column section so that engagement of the inner half bearing with the half bearing outer race withstands compressive forces applied between the header plate and the lift column and engagement of the inner full bearing with the full bearing inner race withstands separating forces applied between the header plate and the lift column while the header plate remains pivotable around the center of rotation.

12. A vertical lift column as defined in claim 11 wherein the column section includes a support plate at its upper end and wherein the half bearing outer race is supported on the support plate.

13. A vertical lift column as defined in claim 12 wherein the fastener secures the full bearing to the support plate.

14. A vertical lift column as defined in claim 13 further including a rocker between the header plate and the support plate for limiting pivoting movement of the header plate in selected directions relative to the support plate.

15. A header plate assembly for supporting a lift beam at the upper end of a lift column in a gantry, comprising:

a support plate mountable at the upper end of the lift gantry, the support plate including a central recess;

a half bearing race received in the central recess;

a header plate having a support collar projecting from one side thereof, the support collar having an open interior:

a half bearing disposed around the support collar and engaging the half bearing race so that the header plate is supported above the support plate by the half bearing and by the half bearing race for pivoting movement relative to the support plate;

a full bearing race received in the open interior of the support collar; and a full bearing received in the full bearing race and secured to the support plate so as to restrain the full bearing race and the header plate coupled thereto against vertical separating movement relative to the support plate.

16. A header plate assembly as defined in claim 15 wherein the full bearing race is retained in the interior of the support collar by means of a locking cap secured to the header plate and having a central portion extending into the interior of the support collar.

17. A header plate assembly as defined in claim 16 wherein the full bearing is secured to the support plate by means of a fastener extending through the full bearing and engaging the support plate.

18. A header plate assembly as defined in claim 17 wherein the support plate includes a boss within the central recess for engaging the fastener.

19. A header plate assembly as defined in claim 18 wherein the full bearing is substantially restrained against vertical movement relative to the support plate when secured to the support plate.

20. A header plate assembly as defined in claim 19 wherein the fastener comprises a bolt having a head and wherein the full bearing is substantially restrained against vertical movement by being constrained between the bolt head at one end and the boss at the other.

* * * * *